US005610569A

United States Patent [19]

Hwang et al.

[11] Patent Number: 5,610,569

[45] Date of Patent: Mar. 11, 1997

[54] STAGGERED HORIZONTAL INDUCTOR FOR USE WITH MULTILAYER SUBSTRATE

[75] Inventors: William B. Hwang, Los Angeles; David M. Lusher, Torrance, both of Calif.

[73] Assignee: Hughes Electronics, Los Angeles, Calif.

[21] Appl. No.: 599,524

[22] Filed: Jan. 31, 1996

[51] Int. Cl.[6] ..... H01F 27/28

[52] U.S. Cl. ..... 336/200; 336/223

[58] Field of Search ..... 336/200, 223, 336/225

[56] References Cited

U.S. PATENT DOCUMENTS 3,614,554 10/1971 Richardson et al. ..... 336/200

3,731,005 5/1973 Shearman ..... 336/200

*Primary Examiner*—Thomas J. Kozma

*Attorney, Agent, or Firm*—Leonard A. Alkov; Wanda K. Denson-Low

[57] ABSTRACT

A co-fired inductor structure that includes a plurality of planar co-fired ceramic dielectric insulating layers (13); a plurality of elongated conductive strips (11-1–11-4, 12-1–12-4, 21-1–21-3, 22-1–22-3) arranged in four groups of parallel elongated conductive strips each group disposed on a respective dielectric insulating layer; and a plurality of via columns (101, 102, 103, 104) for interconnecting the ends of the elongated conductive strips such that the elongated conductive strips and the via columns form a winding.

4 Claims, 3 Drawing Sheets

STAGGERED HORIZONTAL INDUCTOR FOR USE WITH MULTILAYER SUBSTRATE

BACKGROUND OF THE INVENTION

The disclosed invention is directed generally to hybrid multilayer circuit structures, and is directed more particularly to a staggered horizontal inductor structure formed in a unitized multilayer circuit structure.

Hybrid multilayer circuit structures, also known as hybrid microcircuits, implement the interconnection and packaging of discrete circuit devices, and generally include a unitized multilayer circuit structure either formed on a single substrate layer using thick film or thin film techniques, or as a multilayer substrate comprising a plurality of integrally fused insulating layers (e.g., ceramic layers) having conductor traces disposed therebetween. The discrete circuit devices (e.g., integrated circuits) are commonly mounted on the top insulating layer so as not to be covered by another insulating layer or on a insulating layer having die cutouts formed thereon to provide cavities for the discrete devices. Passive components such as capacitors, inductors, and resistors can be formed on the same layer that supports the discrete devices, for example, by thick film processes, or they can be formed between the insulating layers, for example, also by thick film processes. Electrical interconnection of the conductors and components on the different layers is achieved with vias or holes appropriately located and formed in the insulating layers and filled with conductive material, whereby the conductive material is in contact with predetermined conductive traces between the layers that extend over or under the vias.

A known inductor structure formed in a unitized multilayer circuit structure is comprised of a first plurality of parallel elongated conductive traces formed on one layer, a second plurality of parallel elongated conductive traces formed on a different layer, and conductive vias for interconnecting the elongated conductive traces such that the conductive strips and the interconnecting vias form windings around dielectric material. A consideration with such inductor structure is the requirement with known fabrication processes that conductive traces can be spaced by no less that specified limits. This results in inductive components that are larger and have more loss than typical wirewound inductive elements.

SUMMARY OF THE INVENTION

It would therefore be an advantage to provide an inductor structure for a unitized multilayer circuit structure having reduced size and loss.

The foregoing and other advantages are provided by the invention in a co-fired inductor structure that includes a plurality of planar co-fired ceramic dielectric insulating layers; first N parallel elongated conductive strips of predetermined width and predetermined spacing disposed on a first dielectric insulating layer; second N parallel elongated conductive strips of the predetermined width and the predetermined spacing disposed on a second dielectric insulating layer that overlies the first dielectric insulating layer; first N-1 parallel strips of the predetermined width and the predetermined spacing disposed on a third dielectric insulating layer that is between the first dielectric insulating layer and the second dielectric insulating layer; second N-1 parallel strips of the predetermined width and the predetermined spacing disposed on a fourth dielectric insulating layer that is between the second dielectric insulating layer and the third dielectric insulating layer; first via columns respectively interconnecting respective first ends of the first N parallel conductive strips with respective first ends of the second N parallel conductive strips; second via columns respectively interconnecting respective second ends of the first through (N-1)th strips of the second N parallel conductive strips with respective first ends of the first N-1 parallel conductive strips; third via columns respectively interconnecting respective first ends of the first N-1 parallel conductive strips with respective first ends of the second N-1 parallel conductive strips; fourth vias respectively interconnecting respective second ends of the second N-1 strips with respective second ends of the 2nd through Nth strips of the first N parallel conductive strips.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
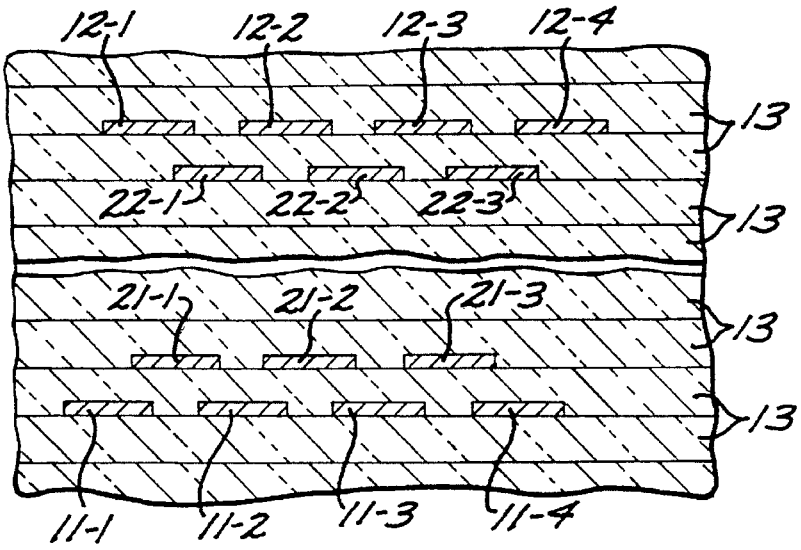
FIG. 1 a schematic elevational sectional view of an inductor structure in accordance with the invention.

In the following detailed description and in the several figures of the drawing, like elements are identified with like reference numerals.

Inductor structures in accordance with the invention are implemented in a unitized multilayer circuit structure that is utilized for interconnecting various discrete circuits mounted on the outside of the unitized structure. The unitized multilayer circuit structure is formed from a plurality of insulating layers (comprising ceramic, for example), conductive traces disposed between the layers, and conductive vias formed in the layers which together with any buried elements (e.g., elements formed on the top of an insulating layer and covered by an overlying insulating layer) are processed to form an integrally fused unitized multilayer structure. The discrete circuits are typically mounted and electrically connected on the outside of the unitized multilayer circuit structure after the unitizing fabrication.

Referring now to FIG. 1, set forth therein an elevational sectional view of an inductor structure in accordance with the invention which includes a plurality of planar dielectric insulating layers 13 laminarly arranged in a vertical stack, and a plurality of elongated conductive strips arranged in a first plurality of N parallel elongated conductive strips 11-1 through 11-4, a second plurality of N parallel elongated conductive strips 12-1 through 12-4, a first plurality of N-1 parallel elongated conductive strips 21-1 through 21-3, and a second plurality of N-1 parallel elongated conductive strips 22-1 through 22-3, each plurality disposed on a respective dielectric insulating layer. The conductive strips are interconnected by a plurality of via columns 101, 102, 103, 104 (FIG. 6) for interconnecting the ends of the elongated conductive strips such that the elongated conductive strips and the via columns form a winding.

Figure 2:
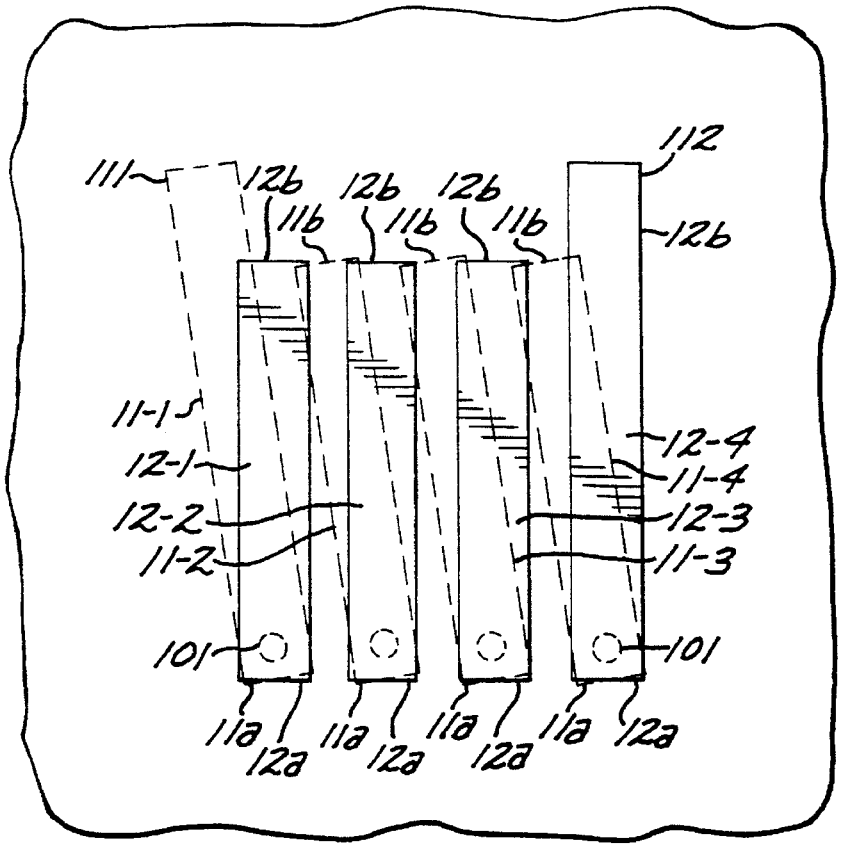
FIG. 2 is a schematic top plan view depicting the relation between an outer top layer of parallel conductive strips and an outer bottom layer of parallel conductive strips of the inductor structure of FIG. 1.

The first plurality of N parallel elongated conductive metallized strips 11-1 through 11-4 are of a predetermined width and a predetermined spacing, and are disposed on an insulating layer 13 in a left to right sequence of a first strip 11-1 through an Nth strip 11-4. The second plurality of N parallel elongated conductive metallized strips 12-1 through 21-4 are of the same predetermined width and spacing as the first plurality of N parallel conductive strips 11-1 through 11-4, and are disposed on an insulating layer 13 that is several layers above the first plurality of N parallel strips 11-1 through 11-4. The second plurality of N parallel conductive strips 12-1 through 12-4 are in a left to right sequence of a first strip 12-1 through an Nth strip 12-4. As illustrated in FIG. 2, the second plurality of N parallel elongated conductive strips 12-1 through 12-4 have first ends **12*a* that vertically overlie corresponding first ends of the first plurality of N parallel elongated conductive strips 11-1 through 11-4, and are at horizontal angle relative to the first N parallel elongated conductive strips 11-1 through 11-2 such that second ends 11*b* of the strips 12-1 through 12-3 of the second plurality of N parallel elongated conductive strips vertically overlie respective gaps between the first plurality of N parallel conductive strips 11-1 through 11-4. As also shown in FIG. 2, the first ends 11*a* of the first N parallel elongated conductive strips 11-1 through 11-4 are respectively electrically connected to respective first ends 12*a* of the second plurality of N parallel strips 12-1 through 12-4 by respective via columns 101. Terminals 111, 112 are to respectively attached to respective second ends of the conductive strips 11-1 and 12-4 for use in electrical interconnection to the inductor of FIG. 1**.

Figure 3:
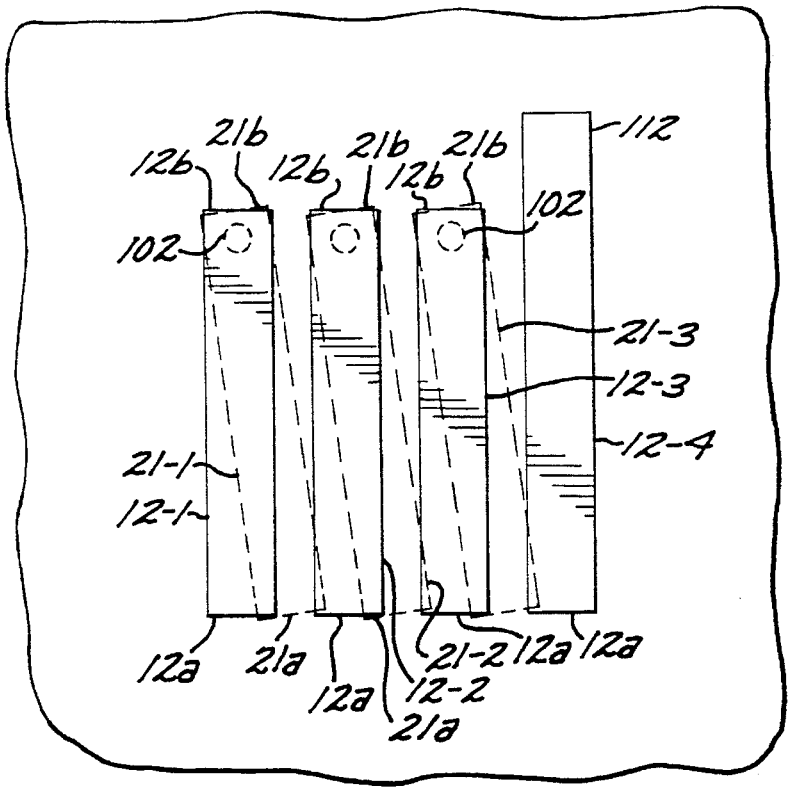
FIG. 3 is a schematic top plan view depicting the relation between the outer top layer of parallel conductive strips and an inner bottom layer of parallel conductive strips of the inductor structure of FIG. 1.

The first plurality of N-1 parallel elongated conductive metallized strips 21-1 through 21-3 are of the same predetermined width and spacing as the first plurality of N parallel elongated conductive strips 11-1 through 11-4, and are disposed on an insulating layer 13 that is above the first plurality of N parallel conductive strips 11-1 through 11-4 and below the second plurality of N parallel conductive strips 12-1 through 12-4. The first plurality of N-1 parallel strips 21-1 through 21-3 are in a left to right sequence of a first strip 21-2 through an (N-1)th strip 21-3, and are more particularly parallel to the underlying first plurality of N parallel conductive strips 13 and vertically aligned with the gaps between the under-lying first plurality of N parallel conductive strips 11-1 through 11-4, such that the first plurality of N-1 parallel strips 21-1 through 21-3 and the first plurality of N parallel strips 11-1 through 11-4 overlap, as illustrated in FIG. 1. As shown in FIG. 3, second ends **21*b* of the first plurality of N-1 parallel strips 21-1 through 21-3 respectively underlie second ends 12*b* of the strips 12-1 through 12-3, and are respectively electrically interconnected with respective second ends 12*b* by via columns 102. The first ends 21*a* of the first plurality of N-1 parallel strips 21-1 through 21-3 respectively underlie gaps between first ends 12*a* of the overlying second N parallel conductive strips 12-1 through 12-4**.

Figure 4:
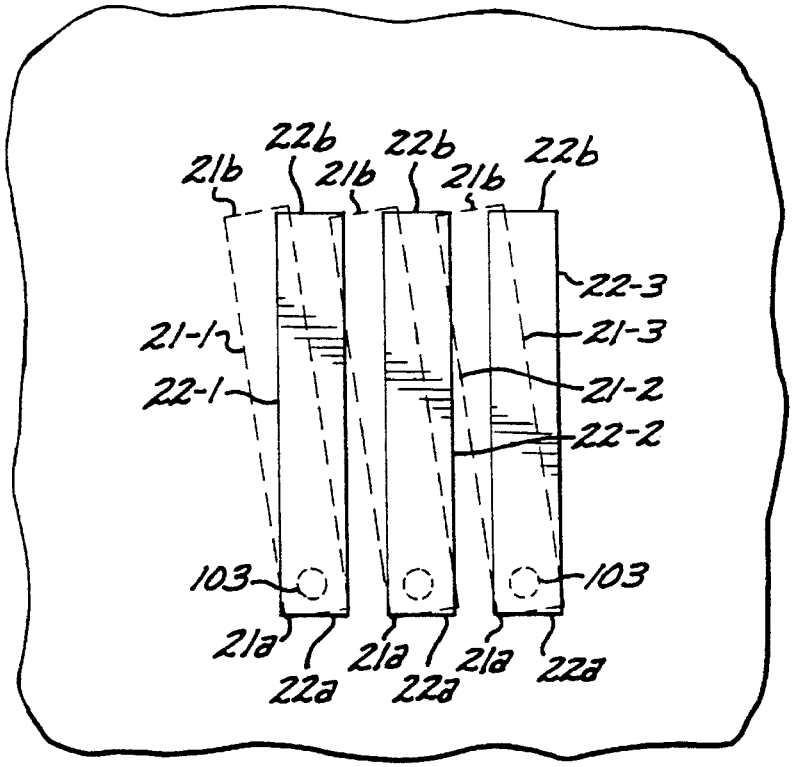
FIG. 4 is a schematic top plan view depicting the relation between an inner top layer of parallel conductive strips and the inner bottom layer of parallel conductive strips of the inductor structure of FIG. 1.
Figure 5:
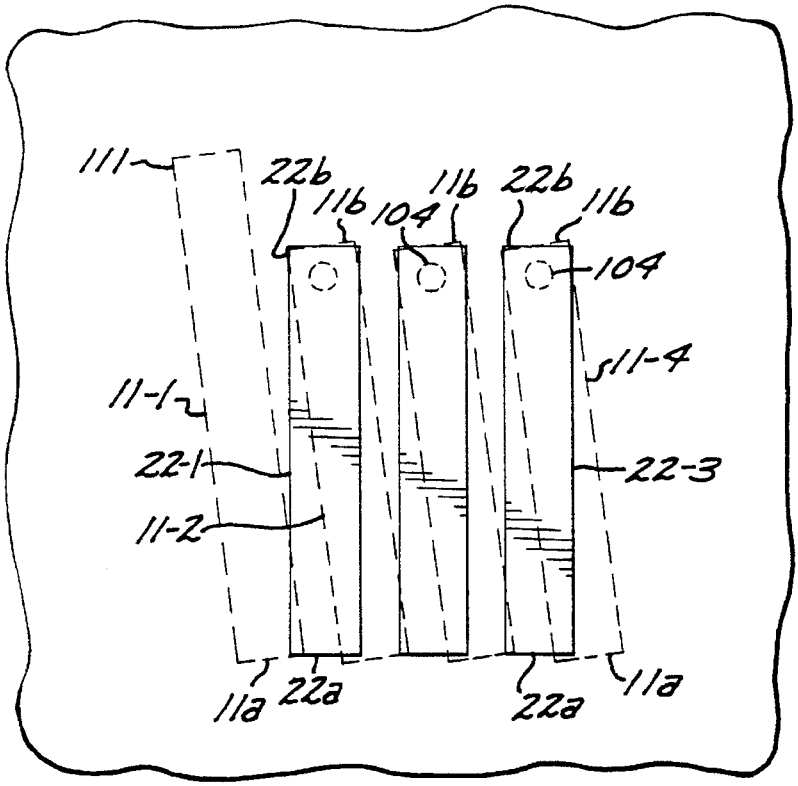
FIG. 5 is a schematic top plan view depicting the relation between the inner top layer of parallel conductive strips and the outer bottom layer of parallel conductive strips of the inductor structure of FIG. 1.

The second plurality of N-1 parallel elongated conductive metallized strips 22-1 through 22-3 are of the same predetermined width and spacing as the first plurality of N parallel conductive strips 11-1 through 11-4, and are disposed on an insulating layer 13 that is above the first plurality of N-1 parallel strips 21-1 through 21-3 and below the second plurality of N parallel conductive strips 12-1 through 12-4. The second plurality of N-1 parallel conductive strips 22-1 through 22-3. The second plurality of N-1 parallel strips 22-1 through 22-3 are in a left to right sequence of a first strip 22-1 through an (N-1)th strip 22-3, and are more particularly parallel to the overlying second plurality of N parallel conductive strips 12-1 through 12-4 and vertically aligned with the gaps between the overlying second plurality of N parallel conductive strips 12-1 through 12-4, such the second plurality of N-1 parallel strips 22-1 through 22-3 and the second plurality of N parallel conductive strips 12-1 through 12-4 overlap, as illustrated in FIG. 1. As shown in FIG. 4, the first ends **22*a* of the second N-1 parallel elongated conductive strips 22-1 through 22-3 vertically overlie respective first ends 21*a* of the first (N-1) parallel elongated strips 21-1 through 21-3. The first ends 22*a* of the second N-1 elongated conductive strips 22-1 through 22-3 are respectively electrically connected to respective first ends 21*a* of the first (N-1) parallel elongated strips 21-1 through 21-3 by respective via columns 103**.

Since the second plurality of N-1 parallel strips 22-1 through 22-3 are vertically aligned with the gaps between the second plurality of N parallel conductive strips 12-1 through 12-4, second ends **22*b* of the second plurality of N-1 parallel strips 22-1 through 22-3 vertically overlie respective second ends of the strips 11-2 through 11-4 of the first plurality of N parallel conductive strips 11-1 through 11-4. The second ends 22b of the second plurality of N-1 parallel strips 22-1 through 22-3 are respectively electrically connected to respective second ends 12*b* of the strips 11-2 through 11-4 of the first plurality of N parallel conductive strips 11-1 through 11-4**.

Figure 6:
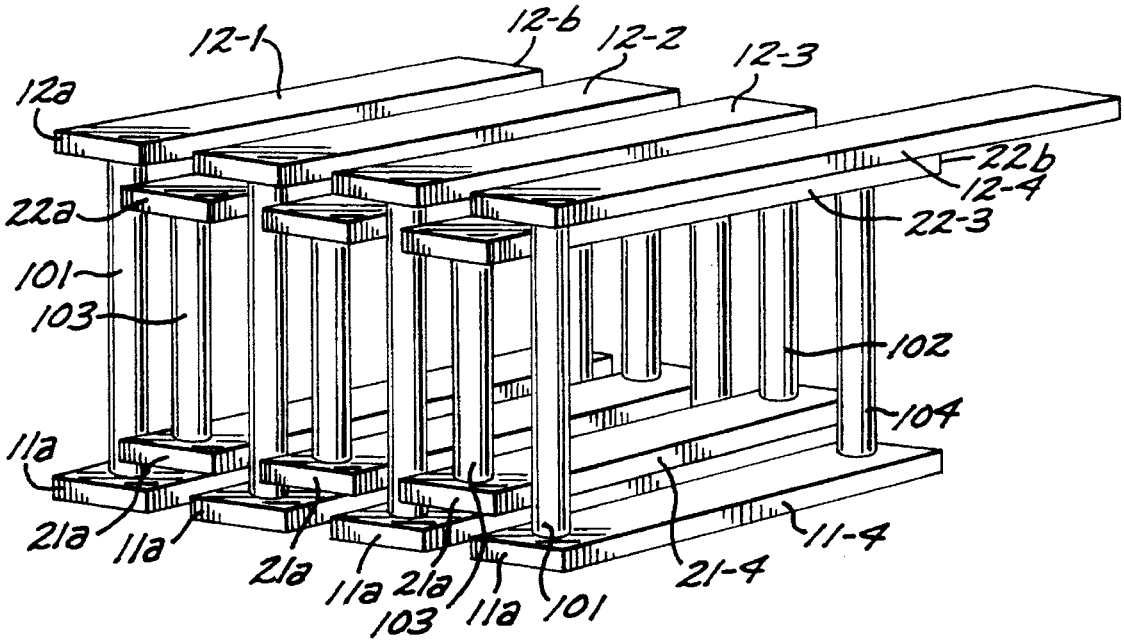
FIG. 6 is a schematic perspective view that illustrates the relationship between the conductive strips and the via columns in the inductor structure of FIG. 1.

Referring now FIG. 6, set forth therein a schematic perspective view that illustrates the relationship between the conductive strips and the via columns in the structure of FIG. 1. As shown in FIG. 6, via columns 101 pass through the gaps between the first ends **21*a* of the first plurality of N-1 parallel strips 21-1 through 21-3 and the gaps between the first ends 22*a* of the second plurality of N-1 parallel strips 22-1 through 22-3. The via columns 102 pass through the gaps between the second ends 22*b* of the second plurality of N-1 parallel strips 22-1 through 22-3**.

Thus, the respective groups of parallel conductive strips and conductive via columns form a winding wherein adjacent turns alternate between two vertically outer layers and two vertically inner layers. The parallel conductive strips on the outer bottom layer are parallel to and overlap the parallel conductive strips on the inner bottom layer, while the parallel conductive strips on the outer top layer are parallel to and overlap the parallel conductive strips on the inner top layer, which eliminates interturn spaces that would be required if adjacent turns were formed on only two layers.

The alternating nature of adjacent turns of the inductor of FIG. 1 can be further appreciated by considering the leftmost conductive strips 11-1, 12-1, 21-1 and 22-1. The first end **12*a* of the conductive strip 12-1 overlies the first end 11*a* of the conductive strip 11-1 and is electrically connected thereto by a via column 101. The second end 12*b* of the conductive strip 12-1 is horizontally displaced from the second end 11***b* of the conductive strip 11-1 and overlies the second end 21*b* of the conductive strip 21-1 which is parallel to the conductive strip 11-1 and partially overlies the conductive strip 11-1. The second end 12*b* of the conductive strip 12-1 is electrically connected to the second end 21*b* of the conductive strip 21-1 by a via column 102. The first end 21*a* of the conductive strip 21-1 underlies the first end 22*a* of the conductive strip 22-1 which is parallel to the conductive strip 12-1 and partially underlies the conductive strip 12-1. The first end 21*a* of the conductive strip 21-1 is connected to the first end 22*a* of the conductive strip 22-1 by a via column 103. The second end 22*b* of the conductive strips 22-1 overlies the second end of the conductive strip 11-1 and is electrically connected thereto by a via column 104.

Inductor structures in accordance with the invention are made, for example, pursuant to low temperature co-fired processing such as disclosed in "Development of a Low Temperature Co-fired Multilayer Ceramic Technology," by William A. Vitriol et al., 1983 ISHM Proceedings, pages 593–598; "Processing and Reliability of Resistors Incorporated Within Low Temperature Co-fired Ceramic Structures," by Ramona G. Pond et al., 1986 ISHM Proceedings, pages 461–472; and "Low Temperature Co-Fireable Ceramics with Co-Fired Resistors," by H. T. Sawhill et al., 1986 ISHM Proceedings, pages 268–271.

In accordance with low temperature co-fired processing, vias are formed in a plurality of green thick film tape layers at locations defined by the desired via configurations of the desired multilayer circuit. The vias are coated or filled with the appropriate fill material, for example, by screen printing. Conductor metallization for conductive traces including the conductive metallization strips are then deposited on the individual tape layers by screen printing, for example, and materials for forming passive components are deposited on the tape layers. The tape layers are laminated and fired at a temperature below 1200 degrees Celsius (typically 850 degrees Celsius) for a predetermined length of time which drives off organic materials contained in the green ceramic tape and forms a solid ceramic substrate.

Inductor structures in accordance with the invention can also be implemented with other technologies for forming unitized multilayer circuit structures, including for example high temperature co-fired ceramics, hard ceramic multilayer single firing technology, and a laminated soft substrate approach.

Although the foregoing has been a description and illustration of specific embodiments of the invention, various modifications and changes thereto can be made by persons skilled in the art without departing from the scope and spirit of the invention as defined by the following claims.

What is claimed is:

1. An inductor structure comprising:

a plurality of planar co-fired ceramic dielectric insulating layers;

first N parallel elongated conductive strips of predetermined width and predetermined spacing disposed on a first dielectric insulating layer and having gaps therebetween, said first N parallel conductive strips being in a sequence of first through Nth strips and having respective first ends and respective second ends;

second N parallel elongated conductive strips of said predetermined width and said predetermined spacing disposed on a second dielectric insulating layer that overlies said first dielectric insulating layer and having gaps therebetween, said second N parallel conductive strips being in a sequence of first through Nth strips having respective first ends and respective second ends, said second N parallel elongated conductive strips being in a sequence from first through Nth strips, and being at an angle relative to said first N parallel conductive strips with respective first ends of said second N parallel conductive strips vertically overlying respective first ends of said first N parallel conductive strips and with said second ends of said second N parallel conductive strips being horizontally displaced in a predetermined direction from respective second ends of said first N parallel conductive strips such that respective second ends of said first through (N-1)th strips of said second N parallel conductive strips overlie respective gaps between first through Nth strips of said first N parallel conductive strips;

first N-1 parallel strips of said predetermined width and said predetermined spacing disposed on a third dielectric insulating layer that is between said first dielectric insulating layer and said second dielectric insulating layer, said first N-1 parallel conductive strips being in a sequence of first through (N-1)th strips and having respective first ends and respective second ends, and being parallel to said first N parallel conductive strips and vertically aligned with the gaps between said first N parallel conductive strips such that respective second ends of said first N-1 parallel conductive strips vertically underlie respective second ends of first through (N-1)th strips of said second N parallel conductive strips;

second N-1 parallel strips of said predetermined width and said predetermined spacing disposed on a fourth dielectric insulating layer that is between said second dielectric insulating layer and said third dielectric insulating layer, said second N-1 parallel conductive strips being in a sequence from first through (N-1)th strips having respective first ends and respective second ends, and being parallel to said second N parallel conductive strips and vertically aligned with the gaps between said second N parallel conductive strips with respective first ends vertically overlying respective first ends of said first N-1 parallel conductive strips and with respective second ends overlying respective second ends of 2nd through Nth strips of said first N parallel conductive strips;

first via columns respectively interconnecting respective first ends of said first N parallel conductive strips with respective first ends of said second N parallel conductive strips;

second via columns respectively interconnecting respective second ends of the first through (N-1)th strips of said second N parallel conductive strips with respective first ends of said first N-1 parallel conductive strips;

third via columns respectively interconnecting respective first ends of said first N-1 parallel conductive strips with respective first ends of said second N-1 parallel conductive strips;

fourth via columns respectively interconnecting respective second ends of said second N-1 strips with respective second ends of said 2nd through Nth strips of said first N parallel conductive strips.

2. The inductor structure of claim 1 wherein said first N-1 parallel elongated conductive strips overlap said first N parallel elongated conductive strips, and wherein said second N parallel elongated conductive strips overlap said second N-1 parallel elongated conductive strips.

3. An inductor structure comprising:

a plurality of planar co-fired ceramic dielectric insulating layers;

a first elongated conductive strip disposed on a first dielectric insulating layer and having a first end and a second end;

a second elongated metallized conductive strip disposed on a second layer that is above said first layer, said second elongated conductive strip having a first end and a second end, and being at a horizontal angle relative to said first elongated conductive strip with said first end of said second elongated conductive strip overlying said first end of said first elongated conductive strip and with said second end of said second elongated conductive strip horizontally displaced from said second end of said first elongated metallized conductive strip;

a third elongated conductive strip disposed on a third dielectric insulating layer that is between said first dielectric insulating layer and said second dielectric insulating layer, said third elongated conductive strip having a first end and a second end, and being parallel to said first elongated conductive strip with said second end of the third strip vertically underlying said second end of said second elongated conductive strip and with said first end of said third elongated conductive strip horizontally displaced in said predetermined direction from said first end of said first elongated conductive strip;

a fourth elongated conductive strip disposed on a fourth dielectric insulating layer that is between said second dielectric insulating layer and said third dielectric insulating layer, said fourth elongated conductive strip having a first end and a second end, and being parallel to said second elongated conductive strip with said first end of said fourth elongated conductive strip vertically overlying said first end of said third elongated conductive strip and with said second end of said fourth elongated conductive strip being horizontally displaced in said predetermined direction from said second end of said third elongated conductive strip;

a first via column for electrically connecting said first end of said first elongated conductive strip to said first end of said second elongated conductive strip;

a second via column for electrically connecting said second end of said second elongated conductive strip to said second end of said third elongated conductive strip; and a third via column for electrically connecting said first end of said third elongated conductive strip to said first end of said fourth elongated conductive strip.

4. The inductor structure of claim 3 wherein said third elongated conductive strip overlaps said first elongated conductive strip, and wherein said second elongated conductive strip overlaps said fourth elongated conductive strip.

* * * * *